US008001715B2

(12) United States Patent
Stokes

(10) Patent No.: US 8,001,715 B2
(45) **Date of Patent: *Aug. 23, 2011**

(54) ILLUMINATION APPARATUS IMPLEMENTING NON-LETHAL WEAPON

(75) Inventor: John H. Stokes, Austin, TX (US)

(73) Assignee: Tactical Devices, Inc., Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/895,784

(22) Filed: Sep. 30, 2010

(65) Prior Publication Data

US 2011/0074303 A1 Mar. 31, 2011

Related U.S. Application Data

(63) Continuation of application No. 11/411,737, filed on Apr. 26, 2006, now Pat. No. 7,827,726.

(60) Provisional application No. 60/675,344, filed on Apr. 26, 2005.

(51) Int. Cl.
*F41G 1/34* (2006.01)
*F41G 1/35* (2006.01)
*F41G 1/36* (2006.01)

(52) U.S. Cl. ..... 42/146; 362/111; 362/231

(58) Field of Classification Search ..... 42/146; 362/111, 231

See application file for complete search history.

(56) References Cited

U.S. PATENT DOCUMENTS

| | | | | |
|---|---|---|---|---|
| 6,367,943 | B1 * | 4/2002 | Tocci et al. | 362/103 |
| 6,488,390 | B1 * | 12/2002 | Lebens et al. | 362/231 |
| 6,902,296 | B2 * | 6/2005 | Searfoss, III | 362/231 |
| 7,125,142 | B2 * | 10/2006 | Wainwright | 362/231 |
| 7,320,532 | B2 * | 1/2008 | Searfoss, III | 362/231 |
| 7,500,763 | B2 * | 3/2009 | Rubtsov | 362/231 |
| 7,621,653 | B2 * | 11/2009 | Hendrie | 362/231 |
| 7,722,212 | B2 * | 5/2010 | Searfoss | 362/231 |
| 7,827,726 | B2 * | 11/2010 | Stokes | 42/146 |
| 7,845,817 | B1 * | 12/2010 | Miller | 362/110 |
| 2003/0095406 | A1 * | 5/2003 | Lebens et al. | 362/231 |
| 2004/0223326 | A1 * | 11/2004 | Wainwright | 362/231 |
| 2007/0153512 | A1 * | 7/2007 | Hendrie | 362/231 |
| 2008/0123332 | A1 * | 5/2008 | Searfoss | 362/231 |

* cited by examiner

*Primary Examiner* — Bret Hayes

(74) *Attorney, Agent, or Firm* — Yudell Isidore Ng Russell PLLC

(57) ABSTRACT

A weapon accessory integrates multiple illumination sources and a mechanism for dispensing a chemical irritant within a single housing for attachment as a fore grip to a firearm. The weapon accessory has selectable microprocessor-controlled multi-modes of operation for providing illumination, sighting or target debilitation. Switches on the outside of the housing enable user setting and control of the multiple modes of operation, which include one or a combination of (i) activating high intensity light emitting diodes (LEDs) to illuminate an object or human subject with either visible or infrared light, (ii) activating a visible or infrared laser for sighting a target, (iii) activating a frequency modulation mode that alternates pulsing white and blue LEDs at three superimposed frequencies to temporarily disable, distract and degrade the vision of a human subject, and (iv) activating the chemical irritant dispenser.

20 Claims, 9 Drawing Sheets

≈ 143μs
7 hz
≈ 50μs
20 hz

≈ 125μs
84hz
≈ 143μs
72 hz
White LEDs
Blue LED
White LEDs
Blue LED

F1 = 1kHZ
F2 = Varies between 7hz and 20hz at rate of F3
F3 = Varies between 2-6hz

ILLUMINATION APPARATUS IMPLEMENTING NON-LETHAL WEAPON

PRIORITY CLAIM

The present application is a continuation of U.S. patent application Ser. No. 11/411,737, now U.S. Pat. No. 7,827,726 B2, titled, "Target Illumination and Sighting Device with Integrated Non-Lethal Weaponry," filed on Apr. 26, 2006, which claims priority to U.S. Provisional Patent Application Ser. No. 60/675,344, titled, "Target Illumination and Sighting Device with Integrated Non-Lethal Weaponry," filed on Apr. 26, 2005, which disclosures are incorporated herein by reference.

BACKGROUND OF THE INVENTION

1. Field of the Invention

The present invention is related in general to illumination devices for weapons, and in particular to illumination devices mounted on a weapon such as a firearm for providing multiple types of illumination used in sighting or illumination of targets. Still more particularly, the present invention relates to targeting and sighting illumination devices for attachment to firearms used in tactical situations.

2. Description of Related Art

Target illumination and sighting devices for attachment to firearms are in common use today by military and law enforcement. In dark indoor or outdoor environments, a military or law enforcement person engaged in an adversarial situation may find it difficult or impossible to efficiently or noiselessly navigate his or her surroundings in darkness. Illumination devices such as flashlights are commonly mounted to firearms on rails or clips, either on the barrel or fore grip, to provide visual assistance in traversing through such dark environments. Illuminator devices have also been used on tactical weapons such as carbines for illuminating targets being fired upon, as well as for momentarily blinding and disorienting an adversary. However, such disorientation is quickly overcome as the eyes adjust to the illumination.

Military and law enforcement use of such devices typically consists of a flashlight and perhaps a laser sighting device, each separately mounted to a firearm on a rail or clip. A few devices available combine the flashlight and invisible laser into a single device. Traditionally, the flashlights have uncertain reliability in tactical environments because they employ a fragile incandescent bulb as the light source, and a rail or clamp mounting system that may be subject to misalignment when the weapon is fired, dropped or bumped. Other such devices have wires and switches extending or protruding from one section of the weapon to another for purposes of activating the lighting or sighting function. Having multiple components and wires dangling from the weapon subjects the illumination devices to further reliability problems because of their exposure to water, dirt, wear, vibration or accidental activation or separation of the wires. Still further, there are no known devices for attachment to a firearm integrating a flashlight with a readily accessible and integrated non-lethal weapon as an alternative to use of the firearm. The present invention addresses these and other shortcomings and deficiencies of the prior art.

BRIEF DESCRIPTION OF DRAWINGS

This invention is described in a preferred embodiment in the following description with reference to the drawings, in which like numbers represent the same or similar elements and one or a plurality of such elements, as follows.

Figures 1A, 1B:
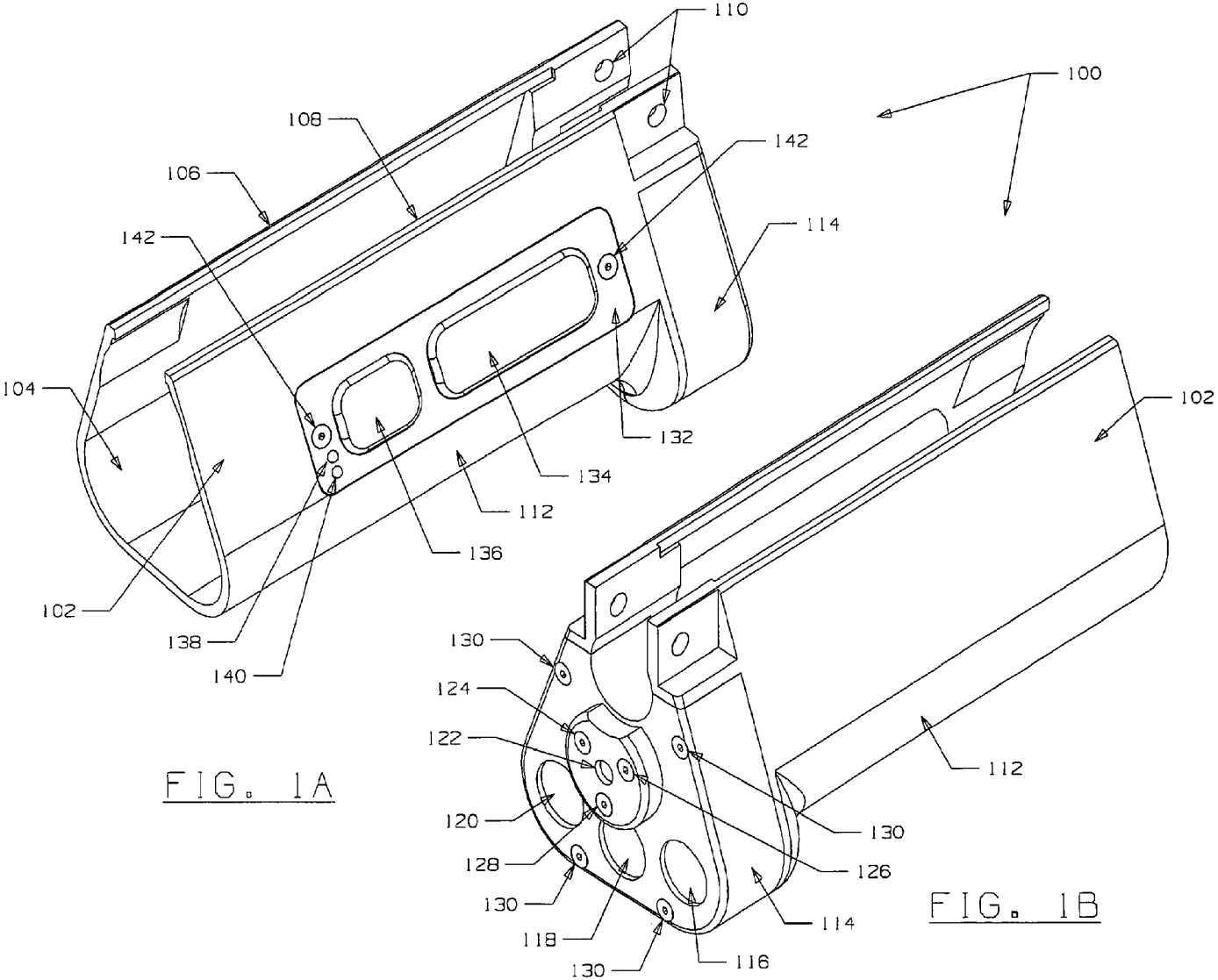
FIGS. 1A and 1B show a right and left perspective view of the weapon accessory, in accordance with the preferred embodiment of the present invention.

All objects, features, and advantages of the present invention will become apparent in the following detailed written description.

DETAILED DESCRIPTION OF PREFERRED EMBODIMENTS

The present invention relates to a portable solid state lighting device operating as a multipurpose integrated weapon accessory. A single housing incorporates illumination sources for illuminating a person or object, a laser source for sighting the weapon, and a chemical irritant dispenser for dispensing an irritant spray. The illumination sources are powered from an internal power source and controlled from among multi-mode operations by a microcontroller. Optics at the front end of the illumination device collimates and focuses the light rays at the output of the illumination source. The sighting device is a coherent illumination source such as a laser, which may be in either a visible or infrared spectrum. A preferred embodiment of the illumination device includes a microprocessor within the housing of the illumination device providing a means of controlling the different illumination sources and modes of operation. The internal microprocessor controls the various modes of operation in response to input signals from multiple control switches on the outside of the housing, which are operable to select the operating mode of the illumination and deterrent devices.

In a preferred embodiment of the present invention, the weapon accessory provides a non-lethal means of incapacitating a human subject by incorporating a strobe light modulation to the illumination sources, causing a stunning effect in a target. The illumination sources can be modulated with a plurality of frequencies, in a selected mode, which serves to temporarily disable, distract and degrade the vision of a recipient of the light. The wavelengths of the illumination source and the pulse rates at which the wavelengths are modulated are chosen to have the maximum debilitating effects on a human subject. In a preferred embodiment, three pulse rates simultaneously modulate the illumination sources.

The weapon accessory provides an additional non-lethal means of incapacitating a human subject by incorporating a pressurized container and valve assembly within the housing, which is filled with both a propellant and an irritant chemical commonly referred to as "pepper spray." The housing contains a discharge device for discharging the pressurized container from an outlet at the front face of the housing by using a combination of mechanical and electrical means.

Further aspects of the preferred embodiment involve mounting the illumination device to the barrel of a firearm in a configuration acting as the fore grip of the weapon. The form of the housing is created to facilitate user grip of the weapon. The single integrated housing is composed of a metallic substance to provide a secure and accurate attachment to the barrel/receiver or rails of the weapon and to provide durability. The single integrated housing thereby integrally attached to the weapon's barrel and receiver presents a streamlined and efficient design that avoids entanglement, dislodgement or accidental activation, resulting from the external wires, switches, mounts, clamps, rails and external batteries seen in the prior art.

Figure 4A:
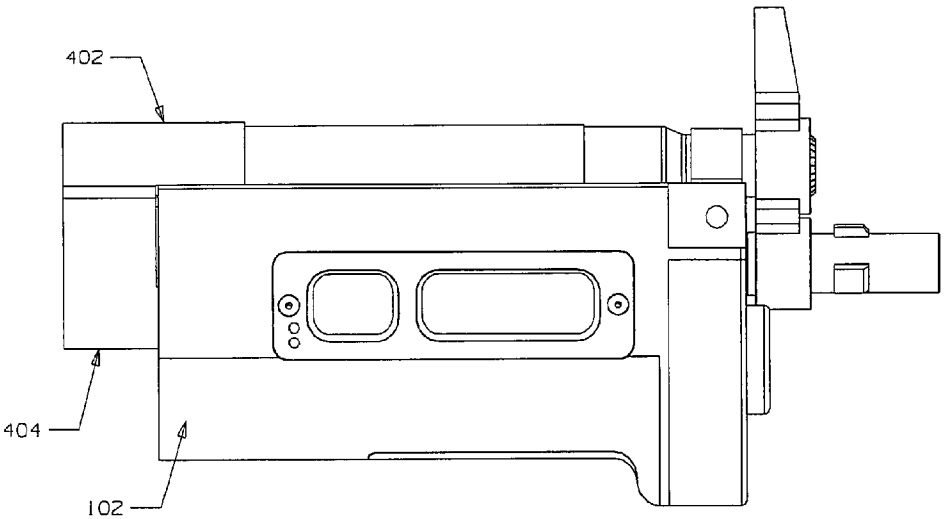
FIGS. 4A-4C show a right, left and front view of the weapon's accessory mounted on a weapon, in accordance with the preferred embodiment of the present invention.
Figure 4B:
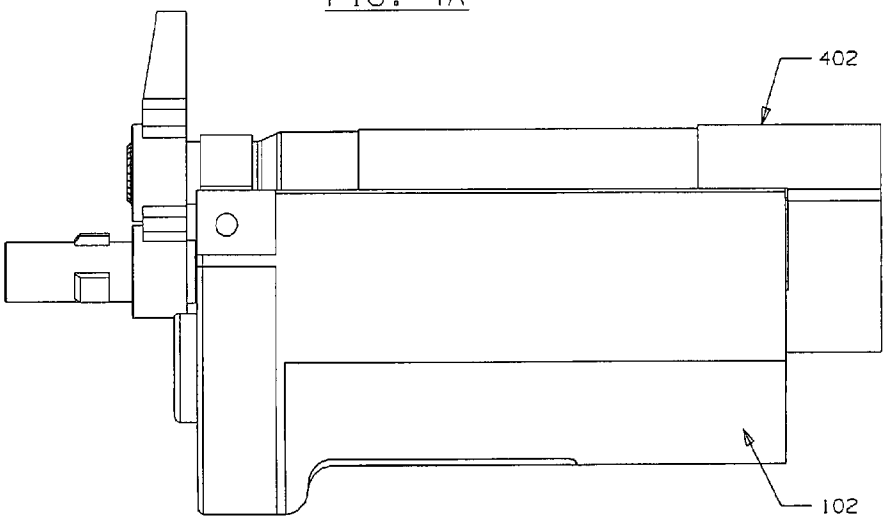
Figure 4C:
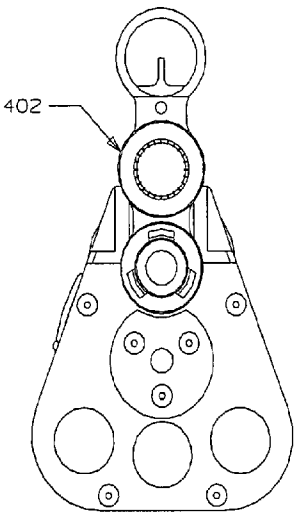
Figure 5:
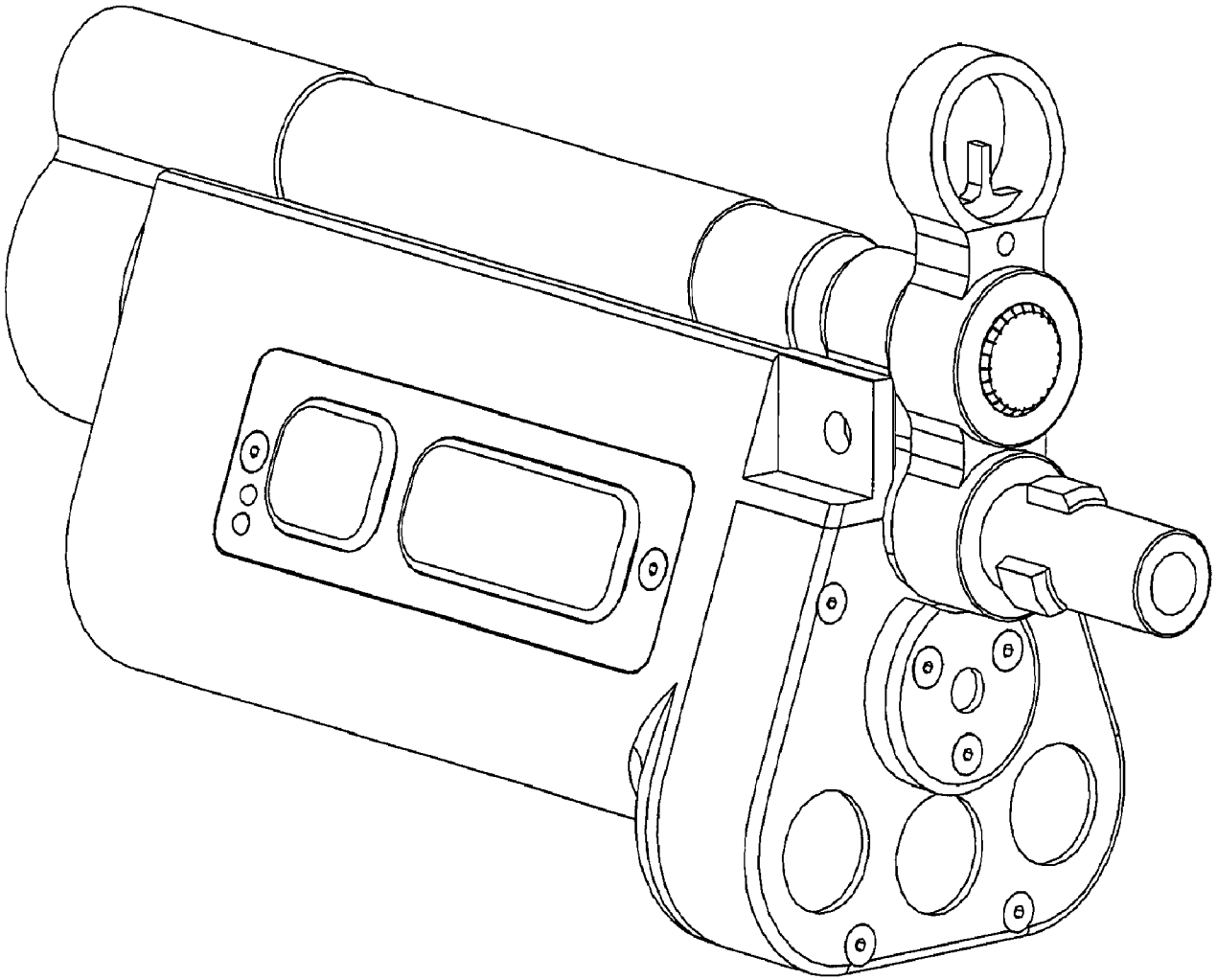
FIG. 5 shows a front-right perspective view of the weapon accessory mounted on a weapon, in accordance with the preferred embodiment of the present invention.

With reference now to the figures, and in particular with reference to FIGS. 1A and 1B, there is shown a perspective view of the rear-right side (FIG. 1A) and the front-left side (FIG. 1B) of a weapon accessory, in accordance with a preferred embodiment of the present invention. FIGS. 2A-2E show a bottom-top, right side, bottom, front and rear views, respectively, of a weapon accessory, in accordance with the preferred embodiment of the present invention. FIGS. 4A-4C show a right, left and front view of the weapon's accessory mounted on a firearm, in accordance with the preferred embodiment of the present invention. For example, firearm 502 may be a Heckler & Koch MP5 automatic firearm. FIG. 5 shows a front-right perspective view of the weapon accessory mounted on a firearm, in accordance with the preferred embodiment of the present invention.

Weapon accessory 100 is contained within a housing 102 configured for attachment to a weapon 402 (FIGS. 4-5). An inner-cavity 104 formed between sides 106 and 108 is designed to be occupied by the barrel and receiver of firearm 502 in a position suitable as a fore grip of the weapon. Housing 102 is fixedly attached to firearm 502 by a pin, screw, clamp or other latching means at various attachment points, such as holes 110, for example. The underside of housing 102 is curved along edge 112 to provide a more comfortable grip for a hand. Attachment of the rear portion of the housing is provided by a rear clamp (not shown) which provides a means for attachment to the front-half of the firearm 502 at the receiver/barrel trunion assembly 504 (seen in FIGS. 4-5).

A front lens enclosure 114 has three large openings (openings 326 in FIG. 3) at its lower portion containing illumination sources 116, 118, 120. The illumination sources may consist of a plurality of solid state or incandescent devices, each of which may emit light at a different wavelength. In a preferred embodiment, illumination sources 116, 118, 120 are high luminance light emitting diodes (LEDs). Front lens enclosure 114 also has a small opening (opening 334 in FIG. 3) at its upper portion containing a sighting laser 122. Laser adjusting screws 124, 126 and 128 permit calibration and alignment of laser 122 with reference to firearm 502. Front lens enclosure 114 is secured to housing 102 by four cover screws 130.

Multiple function switches 134, 136 are located on the outside of the housing 102 in a manner to facilitate easily switching between the various functions and modes of operation of the weapon accessory by manipulation by the user's fingers on the fore grip. Because switches that protrude are more susceptible to accidental engagement or entanglement on foreign objects, further enhancements include the use of flat non-protruding buttons on the side of the illumination housing to avoid functions from being turned on or off or the modes of operation being changed accidentally. The user easily switches between the various functions by placing a finger in contact with a switch cover 132 on housing 102 containing switches 134, 136 (or alternatively sensors). Switch 136 is operable for switching between different modes of operation, and switch 134 along the side of the housing turns the active function on and off. As a safety feature, actuating switches 134, 136 simultaneously provides a means of disabling the current operational mode of the weapon accessory 100, thereby placing the device in a "safety" mode to prevent accidental activation. Tactile feedback is incorporated into the switches 134, 136 to provide the user with a means of determining the exact position of their hand and fingers on the controls of weapon accessory 100. Switches 134, 136 are elevated at a plane slightly above a plane formed by side 108 (for example, such as seen in FIG. 2D) to provide tactile feedback to the fingers of the user for actuation of the switches. In alternative embodiments, switches 134, 136 are formed in a plane equal to the plane of side 108 or at a plane below the plane formed by side 108 to provide added safety against accidental activation of the switches.

As seen in FIG. 1A, side 108 of housing 102 mounts a switch cover 132 including switches 134, 136 and LEDs 138, 140. Switch cover 132 is mounted to side 108 by securing means 142, such as screws. In a preferred embodiment, switch 134 is actuated to turn on or off a selected function of weapon accessory 100. Switch 136 functions to select an operating mode of weapon accessory 100. LEDs 138, 140 are bi-color red/green LEDs and provide a visual indication of the current mode of operation of weapon accessory 100. Each LED 138, 140 may be on, off or blinking. Both lights are off when the illumination sources are off. LED 138 in a steady state green state indicates a "flashlight" mode; LED 140 in a red state indicates a "laser" mode; both LEDs 138 and 140 lit in a green and red state, respectively, indicates flashlight plus laser; LED 138 alternating between red and green states indicates a "StunLight™" mode; LED 138 alternating between red and green states and LED 140 in a red state indicates a laser mode and a "StunLight™" mode; and both LEDs 138 and 140 blinking in a red state indicates a "laser" mode and a "StunLight™" mode, plus a "pepper spray" mode. Other combinations of states serve to indicate other modes such as a "safety" mode wherein both LEDs are steady green.

Figure 3:
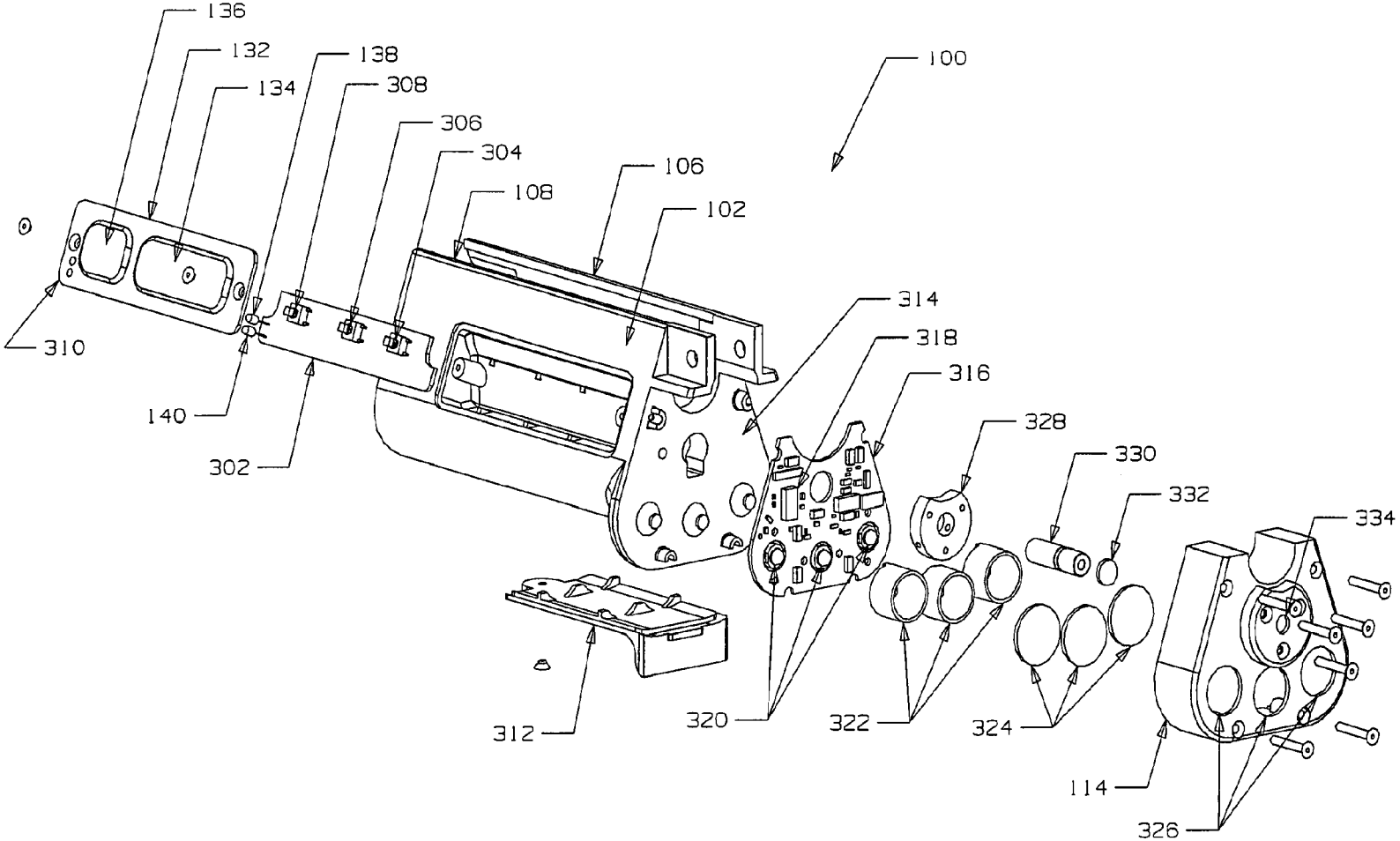
FIG. 3 shows an exploded front-right perspective view of the weapon accessory, in accordance with the preferred embodiment of the present invention.

With reference now to FIG. 3, an exploded perspective view of weapon accessory 100 is shown. Mounted on board 316, an internal microprocessor 318 controls the various modes of operation of the weapon accessory 100. The internal microprocessor 318 also provides additional features such as maintaining full brightness level for each illumination function until the batteries have become fully discharged, providing a visible indication of the state of charge of the batteries, controlling the operating current for the various functions, and providing a visible indication to the user of the function currently selected.

Mounted beneath switch cover 132 is a switch board 302, which is a printed circuit board providing electrical connection between electronic switches 304, 306 and 308, and providing the functionality to power LEDs 138, 140 in accordance with the settings identified by switch 308. When switch board 302 is mounted beneath switch cover 132, LEDs 138, 140 are mounted within holes 310 to provide visual observation of the lights. Electronic switches 304-308 are mounted beneath switches 134, 136 in close proximity such that actuation of switch 136 simultaneously actuates switch 308, and such that actuation of switch 134 in a forward position beneath switch 304 operates to actuate switch 304 and actuation of a portion of switch 134 above electronic switch 306 simultaneously actuates switch 306. In this manner, switch 134 can be made larger for easier On/Off functionality by allowing actuation of either switch 304 or 306 by asserting the corresponding portion of switch 134 will operate to toggle the current mode of the weapon accessory 100 on or off. As a safety feature, simultaneous actuation of switches 136, 134 operates to place the weapon accessory in a "safe" mode, such that the illumination devices may only be turned on after a subsequent simultaneous actuation of switches 136, 134. Electronic switch 308 is functional to provide a mode signal to microprocessor 318 that sets the operational mode of the weapon accessory 100.

Figure 2A:
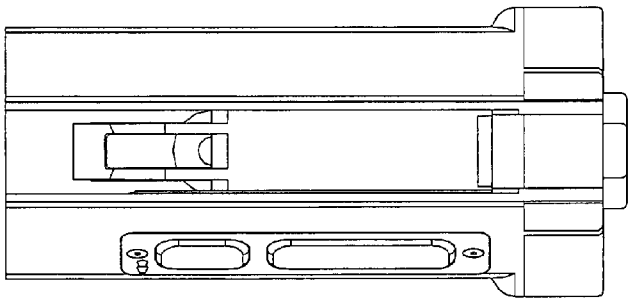
FIGS. 2A-2E show a bottom-top, right side, bottom, front and rear views, respectively, of a weapon accessory, in accordance with the preferred embodiment of the present invention.
Figure 2B:
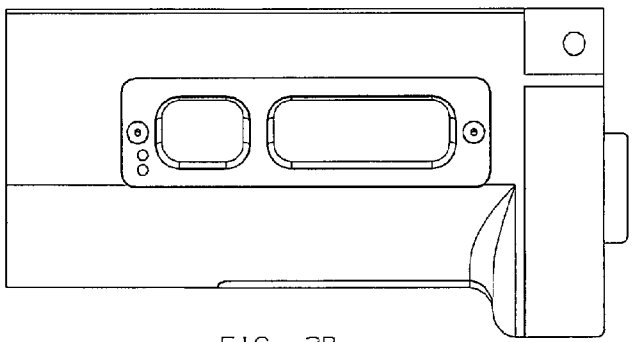
Figure 2C:
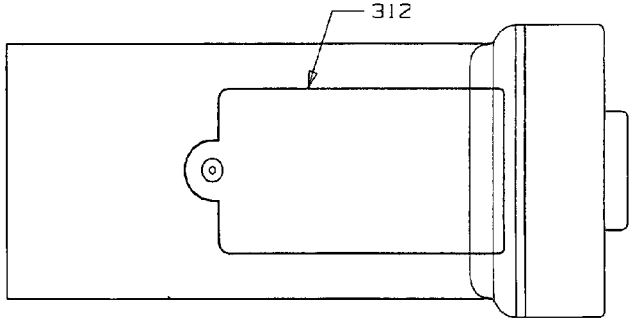
Figure 2D:
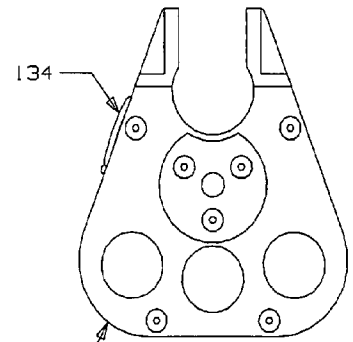
Figure 2E:
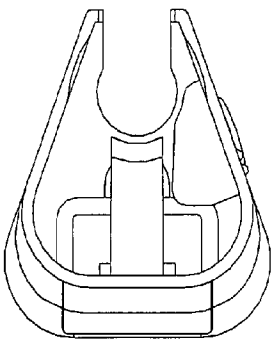

Battery housing cover 312 seen in FIG. 3 is mounted and secured within an opening of housing 102 on its bottom face (as seen in FIG. 2C). Battery housing cover 312 is functional to access and secure a battery (not shown) contained within housing 102. The battery is used to power the illumination sources and electronics on-board the weapon accessory 100. Mounted to a front face 314 of housing 102 is an electronics assembly board 316 comprised of a printed circuit board containing electronic components, including microprocessor 318 and illumination sources 320. In a preferred embodiment, illumination sources 320 are high-luminance LEDs mounted to the surface of electronics assembly 316. Enclosing each of the illumination sources 320, respectively, are cylindrical reflectors 322. Covering the openings of reflectors 322 are lens 344, operating together to provide collimation of the emitted light through holes 326 within front lens enclosure 114 into a narrow beam of no more than 15 degrees.

Also mounted to electronics assembly 316 is a laser retaining collar 328 securely mounting a visible or infrared laser 330 to housing 102. A lens cover 332 covers the light emitting output face of laser 330, which emits a visible or infrared laser light through hole 334 in front lens enclosure 114. Laser 330 is designed to emit a coherent beam of light in either the visible range of 470 nm-670 nm, or in the infrared range of 780 nm-940 nm. In a preferred embodiment of the present invention, laser 330 emits a coherent red beam at 660 nm.

Figure 6:
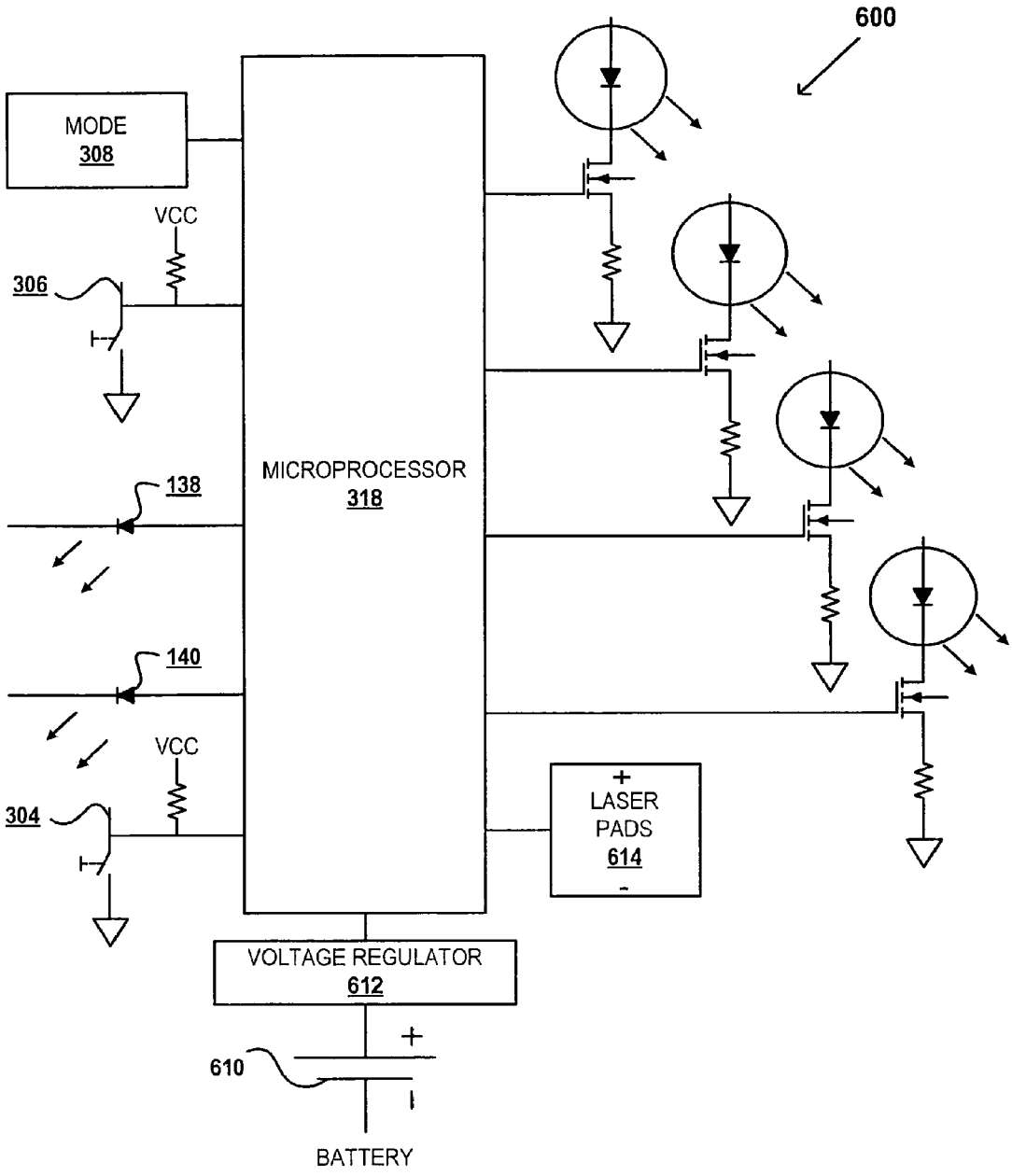
FIG. 6 shows a circuit diagram of the electronics operating the weapon's accessory, in accordance with the preferred embodiment of the present invention.
Figure 8:
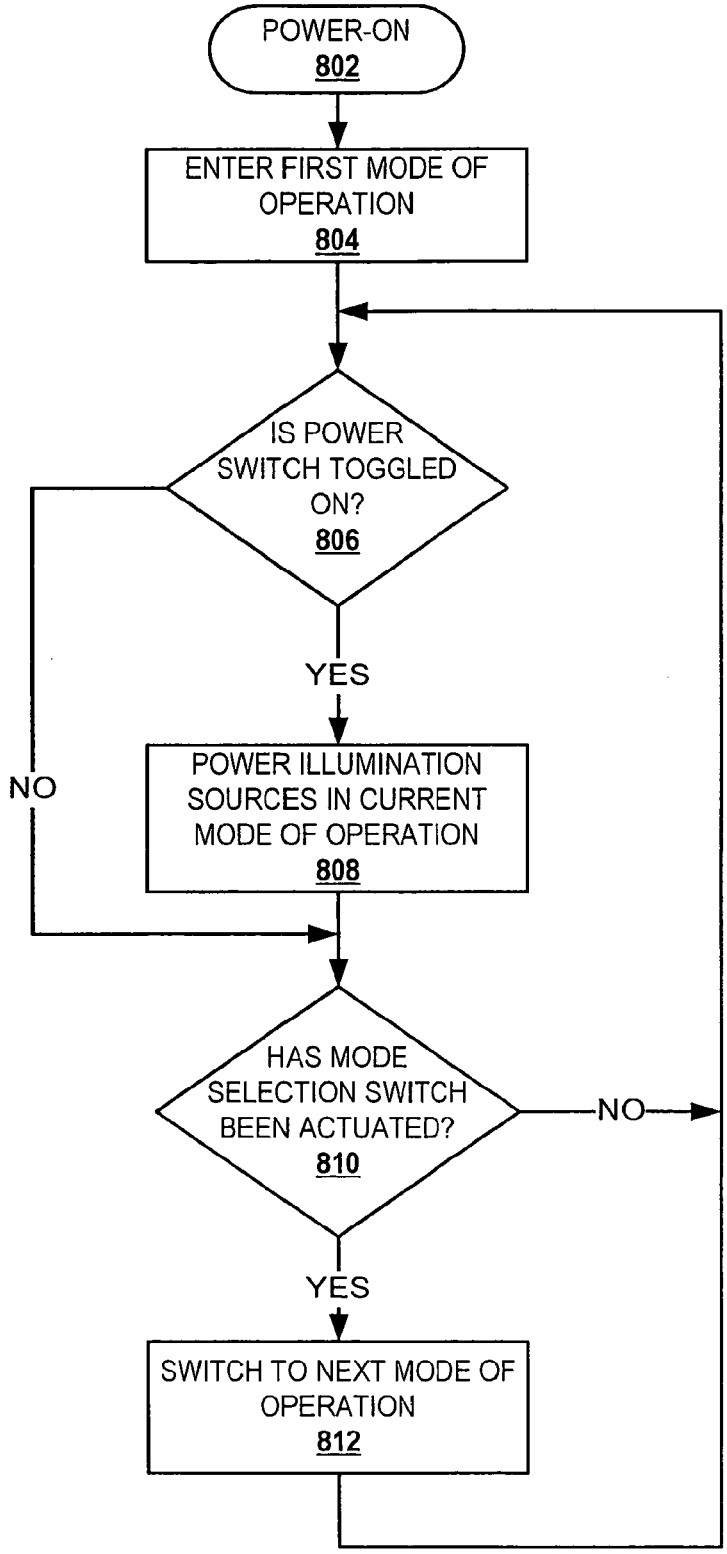
FIG. 8 shows a flow diagram of a process for operating the weapon's accessory, in accordance with the preferred embodiment of the present invention.

With reference now to FIG. 6, there is shown a circuit diagram of the electronics of weapon accessory 100, in accordance with a preferred embodiment of the present invention. Circuit 600 includes a microprocessor or controller 318, power source (610, 612), control switches (304-308) and high intensity and low intensity light sources (LEDs 138, 140, 602, 604, 608, and 610). A battery 610 carried within housing 102 provides power to a voltage regulator 612, thereby providing a voltage regulated power supply to microcontroller 318 and the other devices on electronics board 316. In a preferred embodiment, microprocessor 318 is a standard 8-bit microprocessor such as part no. PIC16F73, as manufactured by Microchip Corporation. LEDs 602, 604 emit light at multiple wavelengths due to a complex phosphor coating and appear white to the human eye. In a preferred embodiment, LEDs 602, 604 are standard solid-state LEDs, such as part number LXHL-PB09, as manufactured by Lumileds Corporation. LED 606 emits light in the 470 nanometers (nm) range, generally a non-coherent blue beam in the visible light spectrum. In a preferred embodiment, LED 606 is a standard solid-state LED, such as part no. LXHL-PW09, as manufactured by Lumileds Corporation. In an alternative preferred embodiment of the present invention, an infrared LED 608 is also included in circuit 600 and emits light in the infrared range of 780 nm-940 nm. To accommodate this additional LED, it will be appreciated that housing 102, front lens enclosure 114 and electronics assembly 316 would need to be modified to provide for one or more additional LEDs (an embodiment showing infrared LEDs 802, 804 is shown in FIGS. 8-9). While selective wavelengths have been shown for LEDs 602-608, as well as for laser 330, it will be appreciated by those skilled in the art that wavelengths at selected ranges may be customized for a particular application within the scope of the present invention, and that the selected wavelengths are merely for the embodiment shown, and are not intended to limit the ranges used for alternative configurations of weapon accessory 100.

As seen in FIG. 6, microprocessor 318 receives control input signals from switches 304, 306 to turn on or off the current selected mode of operation. Microprocessor 318 receives a mode input signal from electronic switch 308 signaling to cycle to the next operational mode in a state sequence. In a preferred embodiment, microprocessor 318 will cycle through four independent modes of operation for weapon accessory 100; however, it will be appreciated that any number of modes or states can be programmed into microprocessor 318. Table I below identifies each of four exemplary modes of operation, and the corresponding functionality implemented by microprocessor 318 in accordance with the selected mode.

TABLE I

| Mode # | Mode Type | Mode Functionality |
|---|---|---|
| 1 | Illumination | White and Blue LEDs enabled to provide illumination at a selected wavelength ("flashlight" mode) |
| 2 | Laser Sighting | Laser enabled for laser sighting |
| 3 | Illumination and Laser | LEDs and laser are enabled |
| 4 | StunLight ™ | LEDs are enabled and pulsed at selected frequency to provide stunning effect |

At power-on of microcontroller 318, a software algorithm stored in its embedded memory (such as read-only memory (ROM)) cycles into a first state of operation. According to Table I, weapon accessory 100 enters into mode 1, thereby powering LEDs 602-606 upon actuation of electronic switches 304, 306. Thereafter, actuation of mode switch 308 causes microprocessor 318 to cycle into the next mode of operation and applying power to laser pads 614 upon actuation of electronic switches 304, 306. Laser pads 614 are physically connected to power pads on laser 330, so power applied to pads 614 will cause activation of the laser. Upon receiving a next actuation of electronic switch 308, microprocessor 318 enters the next mode of operation, enabling power to LEDs 602-606 and laser pads 614 upon actuation of electronic switches 304, 306. Upon receiving a next actuation of electronic switch 308, microprocessor 318 enters the next mode of operation and upon actuation of electronic switches 304, 306 applies a pulsed power signal to LED 606, which is pulsed in accordance with a StunLight™ frequency modulation scheme. Microprocessor 318 will continuously cycle the operating mode from mode 1 to mode 4 and returning to mode 1 in a circular manner with each selection of the mode switch 136.

In accordance with a preferred embodiment of the present invention, the illumination sources can be modulated with a plurality of frequencies, in a selected StunLight™ mode, which serves to temporarily disable, distract and degrade the vision of a recipient of the light. The wavelengths of the illumination source and the pulse rates at which the wavelengths are modulated are chosen to have the maximum debilitating effects on a human subject. In a preferred embodiment, the StunLight™ frequency modulation scheme uses three pulse rates to simultaneously modulate the illumination outputs of LEDs 602, 604, 606 in a manner to temporarily disable, distract, and degrade the vision of a potential assailant or assailants, particularly in low ambient levels or at night. The first pulse rate is a series of high frequency pulses of over 1000 Hz that serve to limit the current and the corresponding optical power output of the illumination sources. The second pulse rate is superimposed on the first frequency and is a series of medium frequency pulses that cause the illumination source to produce a series of visible flashes. In a preferred embodiment, the illumination source is modulated in the visible spectrum at a second frequency between 7 Hz and 20 Hz, which has been shown to produce momentary blinding or debilitating effects when viewed by a human subject. This second medium frequency is further modulated by a third low frequency, which serves to sweep the medium frequency within a narrow range of frequencies to which the human brain is sensitive when applied to a visible light source. In a preferred embodiment, the illumination source is modulated in the visible spectrum at a third frequency between 2 Hz and 6 Hz, which has the effect of sweeping the second frequency between the lower 7 Hz limit and the upper 20 Hz limit for purposes of making the entire range of second frequencies visible within a period of 2-4 seconds. While a preferred embodiment describes frequency modulating three LEDs (602, 604, 606), it will be appreciated that the invention may be implemented by frequency modulating any number of LEDS, including one LED, two LEDs or any number of LEDs greater than three.

Figures 7A, 7B, 7C:
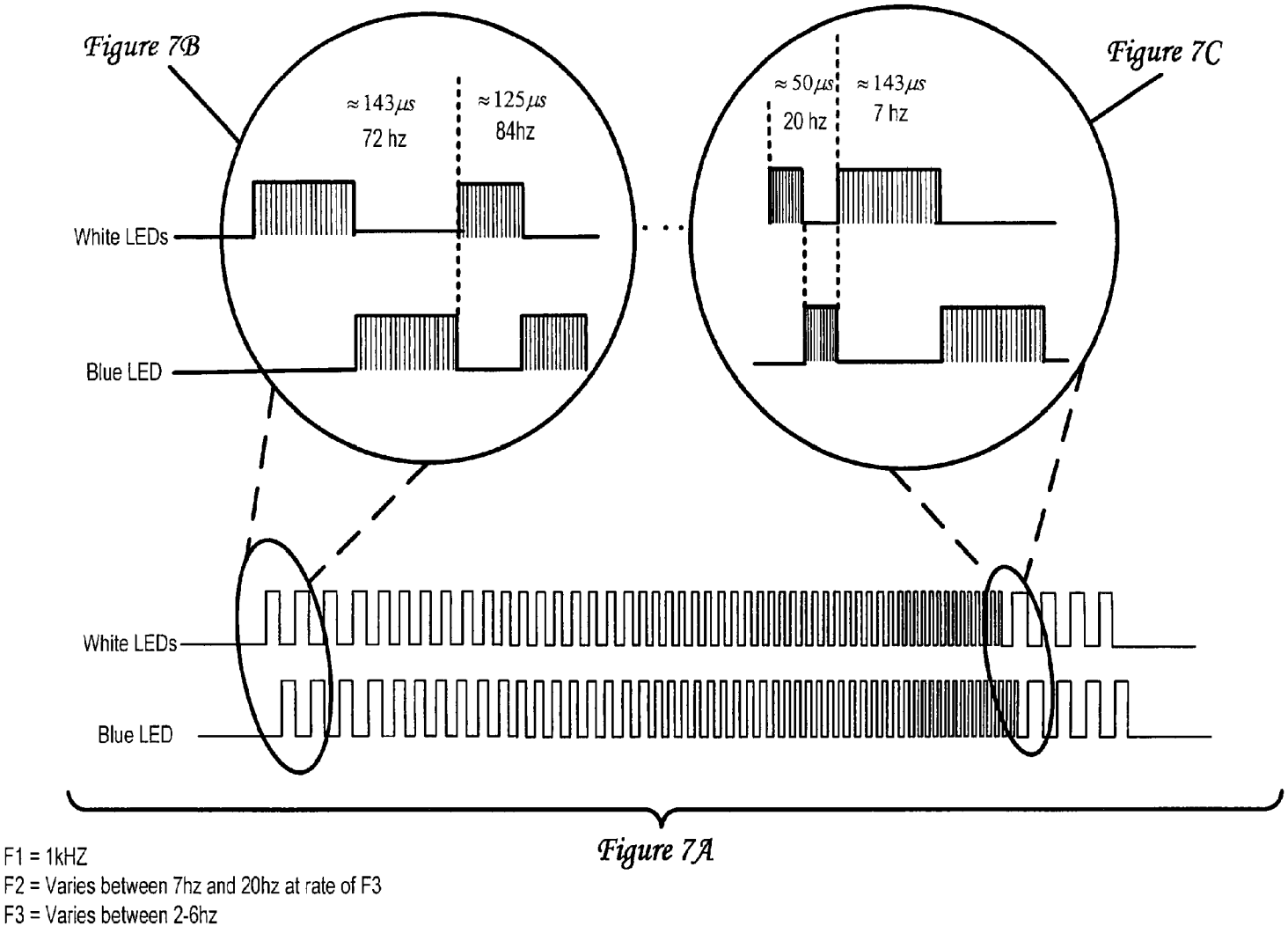
FIGS. 7A-7C show a timing diagram of multiple pulse rates applied to the LEDs when operating in the StunLight mode, in accordance with the preferred embodiment of the present invention.

With reference now to FIGS. 7A-7C, there is shown a timing diagram of the multiple pulse rates applied to the white LEDs 602, 604 and the blue LED 606 when operating in the StunLight™ mode. A first timing signal is applied to the white LEDs 602, 604, and a second timing signal equal to the first, except out of phase by 180 degrees, is applied to the blue LED 606. Each of the white and blue LED timing signals is modulated simultaneously by each of frequencies F1, F2, and F3. In a preferred embodiment of the present invention, F1 is 1 kilohertz (1 kHz), and F2 is a frequency that varies between 7 and 20 hertz at a third modulation rate of F3. F3 is a frequency that varies between 2 and 6 hertz. The resulting timing signals are shown in FIG. 7A as "White LEDs" and "Blue LED", which are shown in magnified views in FIGS. 7B and 7C.

FIG. 7B shows the first cycles of the white and blue LED timing signals at the starting frequency of F2. As seen in FIG. 7B, the first cycle of the white LEDs occurs at an approximate period of 143 microseconds (corresponding to an approximate 7 hertz frequency). The second cycle of the white LEDs is shown to have an approximate period of 125 microseconds (corresponding to an approximate 8 hertz cycle). As will be appreciated, the frequency of the white LED timing pulses increases in accordance with the variation of F3 over time. Moreover, during the half-cycle when the timing signals are at a positive voltage, the power output signal to the LEDs 602, 604, 606 are modulated at the F1 (1 kilohertz) frequency (represented by the lined patterns within each cycle). Also shown in FIG. 7B is the magnified first two cycles of the blue LED modulated timing signal. This timing signal is generated identically to the white LED signal, but with a 180 degree phase difference. As will be appreciated, this will cause the white and blue LED lights to alternating flash at the F2 frequency.

FIG. 7C shows a magnified view of the White and Blue LED timing signals at the end of the frequency sweep of F2 (i.e., when F2 hits the 20 hertz rate). As shown, the last cycle of the White and Blue LED timing signals has a period of approximately 50 microseconds (corresponding to an approximate frequency of 20 hertz). In the next subsequent cycle, F2 switches back to the 7 hertz rate, returning back to a first cycle of a new sweep of the 7 to 20 hertz frequencies.

With reference now to FIG. 8, there is shown a flow diagram of a process executed by a microprocessor for providing multiple modes of operation for a weapon accessory, in accordance with a preferred embodiment of the present invention. The process begins at step 802 when the weapon accessory is powered on. The process proceeds to step 804, where the microprocessor sets the weapon accessory in a first mode of operation. Thereafter, the process proceeds to decision block 806, where it is determined if a power switch on the weapon accessory has been set to an "on" position. If so, the process proceeds to step 808, where the microprocessor controls power to the weapon accessory's illumination sources in accordance with the current mode of operation. From step 808, or from decision block 806 if the power switch has not been switched on, the process proceeds to decision block 810, where it is determined if a mode selection switch on the weapon accessory has been actuated. If not, the process returns to decision block 806, and if so, the process proceeds to step 812, where the microprocessor switches the weapon accessory to a next mode of operation from the current mode of operation. Thereafter, the process returns to decision block 806 to determine if the power switch on the weapon accessory has been toggled on. This process continues to cycle until power is turned off on the weapon accessory.

Figure 9B:
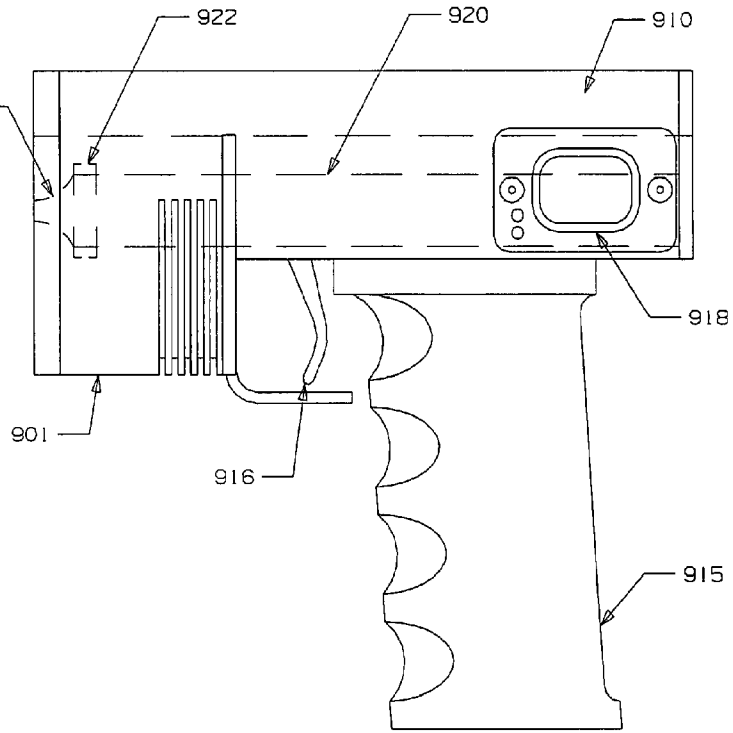
FIGS. 9A-9C show front (FIG. 9A), side (FIG. 9B), and rear (FIG. 9C) views of a weapon accessory of an alternative preferred embodiment of the present invention.
Figure 9A:
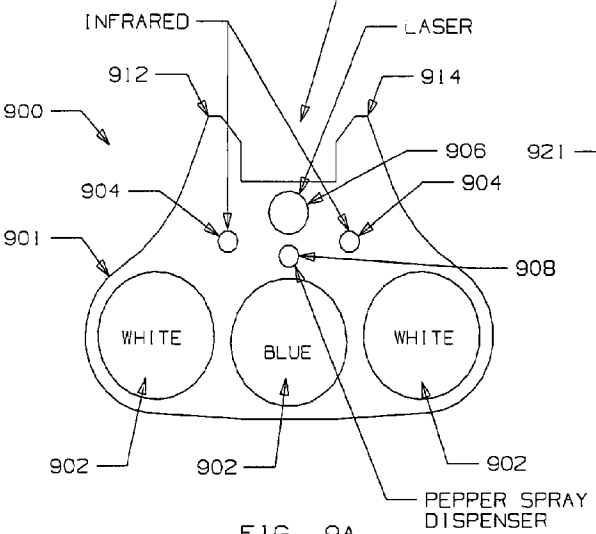
Figure 9C:
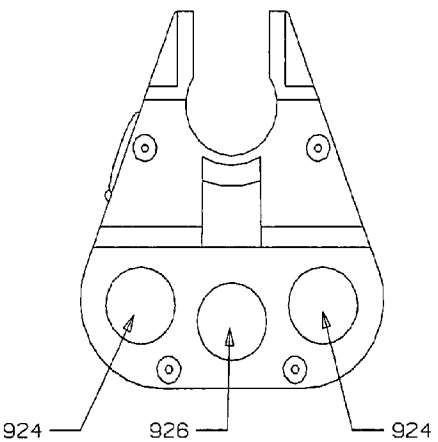

With reference to FIGS. 9A-9C, there are shown front (FIG. 9A), side (FIG. 9B), and rear (FIG. 9C) views of a weapon accessory of an alternative preferred embodiment of the present invention incorporating a non-lethal chemical irritant dispenser as an additional means of incapacitating a human subject. Incorporated into a weapon accessory 900 are a pressurized container 920 and valve assembly 921 within the housing 901. The pressurized container or chamber 920 is filled with both a propellant and an irritant chemical commonly referred to as "pepper spray." Housing 901 contains a discharge device for discharging the pressurized container from an outlet at the front face of the housing by using a combination of mechanical and electrical means as is well know in the art.

As seen in FIG. 9A, weapon accessory 900 has a plurality of illumination sources 902-906 and a single pepper spray dispenser 908 on its front face. Solid-state LEDs 902 include two white lights and one blue light within the visible spectrum. Also included on the front of housing 901 are infrared LEDs 904 and a laser 906. In the center of the multiple illumination sources is a pepper spray dispenser 908 having a storage container containing a propellant and an irritant chemical spray such as a pepper spray that is discharged under the control of weapon accessory 900. A channel 910 is formed between edges 912, 914 and is designed to accommodate the barrel and receiver trunion of a firearm. Similar to weapon accessory 100, weapon accessory 900 is fixedly mounted to a firearm using various holes, screws, clamps and other fastening means.

As seen in FIG. 9B, hand grip 915 acts as a fore grip to the firearm when mounted to a forward portion of the barrel/receiver. A trigger 916 provides an On/Off switch operable by the user for alternatively turning on and off a selected illumination source 902-906 or the pepper spray dispenser 908, as selected by the mode switch 918. Trigger 916 is a momentary switch-type; in its open position, trigger 916 sends an "off" signal to a microprocessor within weapon accessory 900, and when actuated, trigger 916 sends an "on" signal to the internal microprocessor (not shown). FIG. 9B also shows a valve assembly 921 and a container 920 containing the propellant and irritant chemical within housing 901. Discharge of the pepper spray from container 920 is controlled via an inductive coil 922 coupled to the valve assembly 921 in response to an electrical signal applied thereto, in a manner well known in the art. This electrical signal is provided by the internal microprocessor in response to actuation of trigger 916 when weapon accessory 900 is placed in a pepper spray mode from among a plurality of modes set by mode switch 918.

As seen in FIG. 9C, cylindrical compartments 924 are configured for housing batteries applying power to the weapon accessory 900. Cylindrical compartment 926 is a cylindrical opening within housing 901 designed to house pepper spray dispenser 908, including container 920. As will be appreciated, access to compartments 924, 926 is permitted to allow for easy replacement of batteries and pepper spray canisters.

As will be appreciated, weapon accessory 900 has architecture substantially similar to weapon accessory 100, including an electronic assembly 316 for providing electronic control of the illumination sources and pepper spray dispenser in accordance with control inputs from trigger 916 and mode switch 918. In order to accommodate the additional operational mode for the pepper spray dispenser, circuit 600 would be designed to send an additional control signal from microprocessor 318 to coil 922 in response to actuation of trigger 916 when switch 918 has selected a pepper spray dispenser operational mode. In a preferred embodiment of the present invention, microprocessor 318 cycle through six independent modes of operation for weapon accessory 900 in response to mode input signals from switch 918 signaling for microprocessor 318 the cycle to the next operational mode in a state sequence. While six modes are shown in a preferred embodiment, it will be appreciated that any number of modes or states can be programmed into microprocessor 318. Table II below identifies each of six exemplary modes of operation and their corresponding functionality implemented by microprocessor 318 in accordance with the selected mode.

TABLE II

| Mode # | Mode Type | Mode Functionality |
|---|---|---|
| 1 | Illumination | LEDs enabled to provide illumination at a selected wavelength. A "flashlight" mode |
| 2 | Laser Sighting | Laser enabled for laser sighting |
| 3 | Illumination and Laser | LEDs and laser are enabled |
| 4 | Infrared | Infrared LEDs are enabled |
| 5 | StunLight ™ | LEDs are enabled and pulsed at selected frequency to provide stunning effect |
| 6 | StunLight ™ and Pepper Spray | LEDs are enabled and pulsed at selected frequency and Pepper Spray Dispenser is active |

At power-on of microcontroller 318, a software algorithm stored in its embedded memory (such as ROM) cycles into a first state of operation. Modes 1-3, 5 are the same in Table I. When actuation of switch 918 places microprocessor 318 in the fourth mode of operation, actuation of trigger 916 will cause infrared LEDs 904 to illuminate. When actuation of switch 918 places microprocessor 318 in the sixth mode of operation, actuation of trigger 916 will cause an electrical signal to be sent to coil 922, thereby opening valve assembly 921 and firing the pepper spray irritant from pepper spray dispenser 908. In other modes of operation, weapon accessory 900 operates similarly to weapon accessory 100 in providing flashlight, infrared and laser illumination.

While the invention has been particularly shown and described with reference to preferred embodiments, it will be understood by those skilled in the art that various changes in form and detail may be made therein without departing from the spirit and scope of the invention. Any variations, modifications, additions, and improvements to the embodiments described are possible and may fall within the scope of the invention as detailed within the following claims.

The invention claimed is:

1. An illumination apparatus comprising:

a plurality of illumination sources, wherein enabled illumination sources of the plurality of illumination sources illuminate at one or more wavelengths;

a housing, wherein the housing further includes a forward portion carrying the plurality of illumination sources;

a controller, carried within the housing and coupled to the plurality of illumination sources, operable to selectively enable one or more illumination sources of the plurality of illumination sources, and wherein the controller is operable in a plurality of modes, each mode of the plurality of modes enabling for activation a selected one or more illumination sources of the plurality of illumination sources;

an activation device, carried by the housing and coupled to the plurality of illumination sources, operable to activate illumination of one or more illumination sources of the plurality of illumination sources enabled for activation in a current mode of the controller from among the plurality of modes;

means for modulating enabled illumination sources of the plurality of illumination sources at a plurality of frequencies in a selected mode of the controller from among the plurality of modes, wherein the plurality of frequencies includes a first frequency (f1) modulated at a second frequency (f2), wherein f2 is swept over a range of frequencies between a first minimum frequency (f2min) and a first maximum frequency (f2max) at a rate determined by a third frequency (f3), wherein f3 is swept over a range of frequencies between a second minimum frequency (f3min) and a second maximum frequency (f3max).

2. The illumination apparatus according to claim 1, wherein the plurality of frequencies combine to form modulated pulses of illumination from the plurality of illumination sources that burst pulses of illumination at f1 produced at a rate f2 between 7 Hz and 30 Hz, wherein the rate of f2 is swept between 7 Hz and 20 Hz by f3 at a rate between 2 Hz and 6 Hz.

3. The illumination apparatus according to claim 1, wherein one or more of the plurality of illumination sources includes a light emitting diode.

4. The illumination apparatus according to claim 1, wherein the activation device is a switch on the housing and operable by the user to enable at least one illumination source of the plurality of illumination sources.

5. The illumination apparatus according to claim 1, wherein the current mode is selectable by the user.

6. The illumination apparatus according to claim 1, wherein the housing is adapted to be secured to a firearm.

7. The illumination apparatus according to claim 1, further comprising modulating the plurality of frequencies by a series of high frequency pulses over 1000 Hz, wherein the plurality of frequencies are superimposed on the high frequency pulses.

8. A method of controlling an illumination apparatus comprising:

selecting a particular mode of operation of a controller housed in the illumination apparatus from among a plurality of modes;

selectively enabling one or more illumination sources of a plurality of illumination sources within the illumination apparatus corresponding to the selected mode of operation, in response to the particular mode of operation of the controller being selected; and activating illumination from the enabled one or more illumination sources of the plurality of illumination sources in response to a user input, wherein activating illumination includes modulating enabled one or more illumination sources of the plurality of illumination sources at a plurality of frequencies in the selected mode of operation of the controller from among the plurality of modes, wherein the plurality of frequencies are swept over a range of frequencies during illumination of the one or more enabled illumination sources, wherein the plurality of frequencies includes a first frequency (f1) modulated at a second frequency (f2), wherein f2 is swept over a range of frequencies between a first minimum frequency (f2min) and a first maximum frequency (f2max) at a rate determined by a third frequency (f3), wherein f3 is swept over a range of frequencies between a second minimum frequency (f3min) and a second maximum frequency (f3max).

9. The method according to claim 8, wherein f2 is a plurality of frequencies between 7 Hz and 20 Hz, and wherein f2 is swept between 7 Hz and 20 Hz by f3, and wherein f3 is simultaneously swept between 2 Hz and 6 Hz.

10. The method according to claim 8, wherein one or more of the plurality of illumination sources includes a light emitting diode.

11. The method according to claim 8, wherein one or more of the plurality of illumination sources is a laser.

12. The method according to claim 8, further comprising frequency modulating illumination of the activated one or more illumination sources of the plurality of illumination sources in the selected mode of operation of the plurality of modes.

13. The method according to claim 8, further comprising enabling a non-lethal weapon carried by the illumination apparatus in response to selection of a selected mode of operation for the controller of the plurality of modes, and activating the non-lethal weapon in response to a user input.

14. The method according to claim 8, wherein the step of selecting is performed by a user of the illumination apparatus.

15. The method according to claim 8, wherein multiple enabled illumination sources of the plurality of illumination sources illuminate at different wavelengths, and further comprising modulating the activated one or more illumination sources of the plurality of illumination sources at a plurality of frequencies in a selected mode of the controller from among the plurality of modes.

16. An illumination apparatus comprising:

a housing;

an activation device carried by the housing that generates a signal indicating activation;

one or more illumination sources carried by the housing and operable by a user for illuminating a target; and a controller, carried within the housing and coupled to the one or more illumination sources and the activation device for receiving the signal, for simultaneously modulating the one or more illumination sources at a plurality of frequencies in a selected mode of the controller, wherein the controller modulates the one or more illumination sources at a plurality of frequencies in a selected mode of operation of the controller from among a plurality of modes in response to the signal from the activation device, wherein the plurality of frequencies includes a first frequency (f1) modulated at a second frequency (f2), wherein f2 is swept over a range of frequencies between a first minimum frequency (f2min) and a first maximum frequency (f2max) at a rate determined by a third frequency (f3), wherein f3 is swept over a range of frequencies between a second minimum frequency (f3min) and a second maximum frequency (f3max).

17. The illumination apparatus of claim 16, wherein the illumination source includes multiple illumination sources that illuminate at different wavelengths in the selected mode of operation, and further wherein the multiple illumination sources are modulated at the plurality of frequencies in the selected mode of the controller.

18. The illumination apparatus of claim 16, wherein the housing includes an activation device operable by a user for enabling the selected mode of the controller.

19. The illumination apparatus of claim 16, wherein the illumination source includes a light emitting diode.

20. The illumination apparatus of claim 16, wherein the housing is adapted to be secured to a firearm.

* * * * *